United States Patent [19]

Jepson et al.

[11] 3,985,363

[45] Oct. 12, 1976

[54] GOLF CLUB WOOD

[75] Inventors: John W. Jepson, Marion; Walter Reid; Robert A. Brown, both of Mattapoisett, all of Mass.

[73] Assignee: Acushnet Company, New Bedford, Mass.

[22] Filed: Oct. 2, 1974

[21] Appl. No.: 511,128

Related U.S. Application Data

[63] Continuation-in-part of Ser. No. 387,760, Aug. 13, 1973, abandoned.

[52] U.S. Cl. ..... 273/173; 273/80.5; 273/167 J; 273/167 K

[51] Int. Cl.[2] ..... A63B 53/04; A63B 53/02

[58] Field of Search ..... 273/77 R, 80.1–80.8, 273/164, 167–175, 78

[56] References Cited

UNITED STATES PATENTS

| | | | |
|---|---|---|---|
| 690,996 | 1/1902 | McRansom | 273/77 R |
| 745,044 | 11/1903 | Dunn | 273/167 K X |
| 1,000,982 | 8/1911 | Biddle | 273/174 |
| 1,444,409 | 2/1923 | Willmott | 273/173 X |
| 1,524,488 | 1/1925 | Read | 273/169 |
| 1,535,270 | 4/1925 | Tyler | 273/173 X |
| 1,589,707 | 6/1926 | Kraeuter | 273/80.5 |
| 1,595,589 | 8/1926 | Tyler | 273/169 X |
| 1,678,637 | 7/1928 | Drevitson | 273/173 X |
| 1,780,625 | 11/1930 | Mattern | 273/169 |
| 1,968,092 | 7/1934 | Oldham | 273/169 |
| 1,994,149 | 3/1935 | Root | 273/167 K X |
| 2,083,189 | 6/1937 | Crooker | 273/167 E |
| 2,386,552 | 10/1945 | Hill | 273/79 |
| 2,447,967 | 8/1948 | Stone | 273/169 X |
| 2,451,262 | 10/1948 | Watkins | 273/171 X |
| 2,880,002 | 3/1959 | Wetty | 273/169 |
| 2,968,486 | 1/1961 | Walton | 273/173 |
| 3,190,651 | 6/1965 | Thomas | 273/173 X |
| 3,266,805 | 8/1966 | Bulla | 273/78 |
| 3,390,881 | 7/1968 | Senne | 273/173 |
| 3,468,544 | 9/1969 | Antonious | 273/167 E X |
| 3,516,674 | 6/1970 | Scarborough | 273/169 |
| D97,418 | 11/1935 | Smith | 273/167 K X |
| D132,553 | 5/1942 | Cowan | D34/5 GH |

FOREIGN PATENTS OR APPLICATIONS

| | | | |
|---|---|---|---|
| 720,725 | 11/1965 | Canada | 273/79 |
| 415,599 | 8/1934 | United Kingdom | 273/167 R |
| 766,831 | 1/1957 | United Kingdom | 273/167 R |
| 883,857 | 12/1961 | United Kingdom | 273/173 |
| 9,847 | 4/1912 | United Kingdom | 273/167 F |
| 192,025 | 1/1923 | United Kingdom | 273/169 |
| 5,368 | 3/1894 | United Kingdom | 273/78 |
| 4,631 | 3/1900 | United Kingdom | 273/78 |
| 1,063,798 | 3/1967 | United Kingdom | 273/167 A |

*Primary Examiner*—Richard J. Apley
*Attorney, Agent, or Firm*—Eyre, Mann, Lucas & Just

[57] ABSTRACT

An improved wood type golf club is disclosed. A reinforcing member is provided in the club whereby the strength of attachment of the shaft to the club is greater than with conventional wood type clubs. Additionally, because of the shape of the reinforcing member, a portion of the weight of the club head can be moved out to the peripheral regions thereof thereby providing a greater moment of inertia and a correspondingly better club. Furthermore, by means of providing edge radii of at least 0.15 inches and 0.25 inches on the bottom and top leading edges respectively of the face of the club and with a "trip step" there is a marked reduction in wind resistance thus lowering the power needed to swing the club or increasing club head velocity for equal energy input.

35 Claims, 8 Drawing Figures

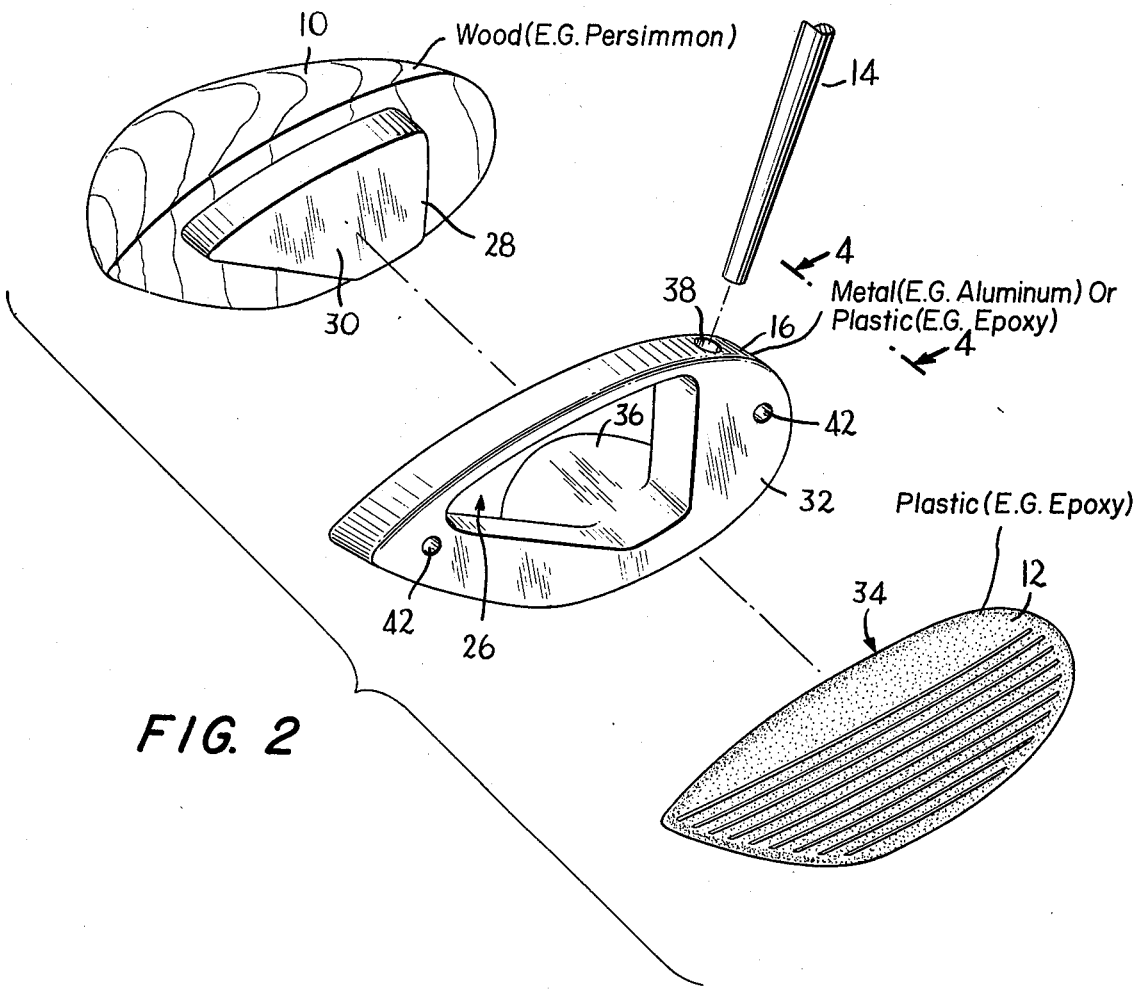
FIG. 2
FIG. 1
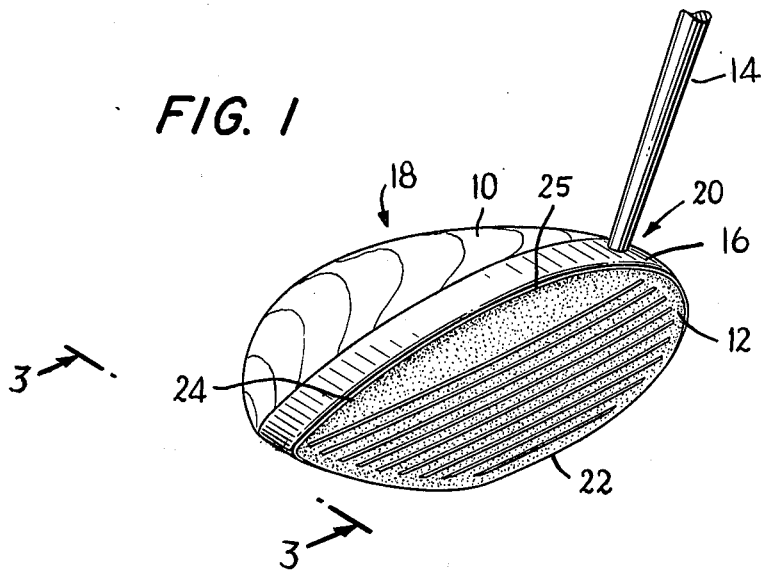

GOLF CLUB WOOD

This application is a continuation-in-part of prior U.S. Application Ser. no. 387,760 filed Aug. 13, 1973 and now abandoned.

The present invention relates to an improved wood type golf club, the improvement being an increase in strength of the club with respect to joining of the club head to the shaft while simultaneously being able to achieve better weight distribution and reduced air resistance.

In accordance with the present invention, the shaft is affixed to the club head without the use of the commonly employed neck. The neck of a golf club is well known in the art and is essentially a truncated conical extension of the wood club head block located on the club head at the point where the shaft is joined to the club head. The neck is used for added strength in the area of the joining of the shaft and the club head. The neck, since it has the shape of a rather large inverted truncated cone, and extends for a considerable length of the shaft, requires a considerable amount of club head material. Since this is usually wood, the cost of manufacture can be substantially increased. Furthermore, the neck produces comparatively high drag primarily because of the inertial forces which cause the airstream to separate from the neck near its point of maximum diameter. A turbulent low pressure area is formed on the downstream side of a cone and with respect to the neck of a golf club this increases the drag of the club head. By eliminating the neck, club head drag can be reduced by approximately 20 percent with respect to a comparable club head which has a standard neck. While the remaining cylindrical metal shaft is still a poor aerodynamic form, it is far better than the neck since the shaft diameter is much smaller than the neck diameter and hence the pressure differential between upstream and downstream sides is applied over a much smaller area.

As mentioned hereinbefore, the primary purpose of the neck in a golf club is to increase the strength of the club at the point where the shaft is affixed to the club head. Elimination of the neck, of course, eliminates this strength. However, in accordance with the present invention, the shaft is affixed to a reinforcing collar rather than to the club head itself. In general, the club head material of a wood type club is made of persimmon wood or laminated wood, the latter being more predominant today. The collar for holding the shaft according to the present invention has substantially greater strength than the club head block whereby the attachment of the shaft to the club head without the use of a neck is actually stronger than in conventional club heads which use a wooden neck. The collar for receiving the shaft can be made of metal such as aluminum or magnesium, or plastic such as epoxies, polycarbonates, butyrates or phenolics. The preferred material for the collar is aluminum both because of its strength and because of the fact that it has a considerably greater density than wood. The collar extends substantially throughout a cross sectional periphery of the club between the club head block and the face plate. The collar is preferably a closed loop since this will add extra weight to the heel and toe areas of the club. This construction aids in reducing hooking and slicing of golf balls hit with the clubs of the present invention for the reasons as described for example in U.S. Pat. No. 3,722,887.

Another advantage of the reinforcing collar of the present invention is that is permits the use of woods other than persimmon or laminated woods. Persimmon or laminated woods are usually employed because of their strength, especially their strength in the neck region where they reinforce the attachment of the shaft to the club head block. However, since in accordance with the present invention a reinforcing collar is used, it is not necessary to use persimmon or laminated wood (although either of these may be employed if desired). In fact, excellent results have been obtained using maple wood. Other suitable woods include birch, American beech, black cherry, American Holly and elm. In addition to lowering the cost of the club head, the use of these other hard woods can materially improve the "feel" of the club, especially as compared to laminated woods which, in the opinion of many golfers, do not have good "feel." The use of these other hard woods also avoids the problems associated with persimmon today in that not only is persimmon quite varying in grain and very expensive but in some cases it is not even available at any price because of the large demand for the wood.

While the reinforcing collar of the present invention reduces the need for club head wood strength, there must still be strength in the attachment of the club head to the shaft. Since the length of shaft affixed in the club head is less in accordance with the present invention than in conventional clubs, a reinforcing sleeve for the shaft may be employed if considered necessary or desirable. Such a sleeve is particularly desirable where it is desired to make a lightweight shaft.

In a typical golfer's swing, the club head of a wood type golf club is accelerated from an initial velocity of 0 to a velocity of 140 feet per second at the point of impact with the golf ball. Movement of the club head through the air produces an aerodymanic drag force which is directly related to the club head velocity and the design of the club. The drag force, multiplied by the distance through which the club head travels, represents the work which the golfer must expend in overcoming air resistance. This work is typically on the order of 8 foot-pounds.

As is well known, the mass times the velocity of the golf ball is directly related to the mass times the velocity of the golf club hitting the golf ball. Keeping the same weight for the club head and the ball, the only way to increase the initial velocity of the ball, and thus the distance it will travel, is to increase the velocity of the club head. A reduction in drag of the club head permits more of the energy expended by the golfer to be transferred to club head velocity. Thus, drag reduction results in increased club head velocity which proportionately increases the initial velocity of the ball being hit resulting in greater distance of travel of the ball, all other conditions being equal.

Conventional wood type golf clubs are relatively high in drag and have a drag coefficient which generally runs from 0.50 to 0.80 or even higher depending to a great deal on the design of the club head. It has been discovered that the high drag results primarily from flow separation from the club body which causes a large pressure differential between the leading and trailing surfaces. In accordance with the present invention, these high drag forces are substantially reduced by minimizing flow separation.

It has been discovered that two of the principle causes of flow separation are squared leading edges on the front face of the club head and the neck for affixing the shaft to the club head.

In accordance with one aspect of the present invention the leading edge of at least the top and preferably also the bottom of the club head are rounded and the top edge is provided with a step commonly referred to as a "trip step."The preferred minimum radius of the lower leading edge of the club head is 0.15 inches and the required minimum radius of the top of the leading edge of the club head is 0.25 inches. The minimum required upper radius is greater than the minimum lower radius because turbulence generated by entrance of the shaft into the body tends to aggravate flow separation tendencies on the upper club surface.

The trip step is located in the upper rounded leading edge of the club head between the middle and downstream side of the radius. Furthermore, the trip step is located ahead of the point of maximum club thickness, the thickness of the club meaning the distance from top to sole. The trip step causes the boundary layer of air flow to become turbulent at a lower flow velocity than would be experienced without the trip step. Turbulent mixing within the boundary layer decreases the velocity gradient in the airstream which in turn decreases the tendency of the airstream to separate from the club surface thus reducing drag on the club head.

There can also be provided a trip step in the radius of the lower leading edge of the club head, if desired. It is pointed out, however, that this is not considered a necessary feature of the invention.

These and other features of the present invention may be more fully understood with reference to the drawings in which:

FIG. 1 shows a perspective view of the golf club of the present invention;

FIG. 2 is a break awaay view of the embodiment of FIG. 1;

Figure 3:
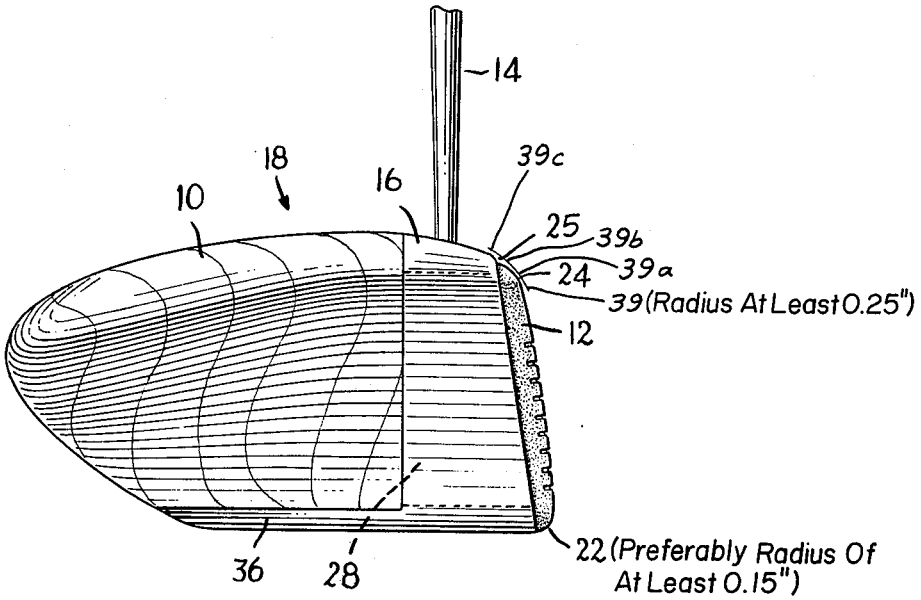
FIG. 3 is an end view of an alternate embodiment of FIG. 1 from the toe end of the gold club.

In FIG. 1 is shown a golf club according to the present invention comprising a club head block 10, a face plate 12, a shaft 14 and a reinforcing collar 16 for affixing the shaft 14 to the club head 18. As can be seen, there is no wooden neck where the shaft 14 is attached to the club head 18. A neck would generally be present in the area indicated by 20. The club head is preferably provided with a rounded edge 22 at the leading edge of the bottom of the club head 18. A second rounded edge 24 is preferably provided at the top leading edge of the club head 18. The top rounded edge 24 is preferably provided with a step 25 in accordance with the present invention.

FIG. 2 is a break away view of FIG. 1 showing the preferred embodiment of the various components of the club head including the club head block 10, the collar 16, the face plate 12 and the shaft 14. As shown in the figure, the collar 16 has a hole 26 which extends from the front to the back of the collar so that the collar has a closed loop shape. While this hole is not entirely necessary, it is highly desirable and should be at least one half of a square inch in cross sectional area. The club head block 10 preferably has a protrusion 28 which is the same in peripheral dimension as the interior peripheral dimension of the hole 26 of the collar 16. The depth of the protrusion 28 is the same as the width of the collar 16 so that when the two are combined the front face 30 of the protrusion 28 is in a planar surface relationship with the front face 32 of the collar 16.

When the three components, the club head block, the collar, and the face plate are assembled, the front face 30 of the club head block 10 will engage the back face 34 of the face plate 12. This is quite important since it imparts good "feel" to the club. There is additional advantage in making the collar of a donut shape (i.e., with a hole in the middle) in that this particular configuration distributes the greatest mass towards the heel and toe regions of the club thus increasing the radius of gyration of the club head and decreasing hook and slicing as described in U.S. Pat. No. 3,722,887. Furthermore, the hole in the center of the collar permits the club to be maintained within standard swing weights, a desiderata which is difficult to accomplish with a solid reinforcing member. It will also be appreciated that the donut shape of the collar is especially useful to reinforce the club head block since it encircles the protrusion on the club head block. This considerably strengthens the overall club head structure.

It will be understood that if desired, the protrusion 28 could be on the face plate 12 rather than on the club head block 10 since in this case also the face plate would be in direct contact with the club head block and would impart good "feel". However, it has been found that a thick face plate does not impart quite as good "feel" as does the preferred embodiment where the protrusion is on the club head block. Additionally, where the collar 16 is made of metal or a similar heavy material, it is desirable to have the protrusion on the club head block since the specific gravity of the wood is considerably less than the specific gravity of the face plate. If the protrusion is on the face plate, this will increase the total weight of the club head and this could be undesirable since the club head weight has already been increased to a degree by the addition of the metal collar.

When the collar 16 is made of plastic, it can be of the same material as the face plate or of a different material. If the collar is made of the same material as the face plate, then the collar and the face plate can be molded as a single integral piece.

For ease of assembly, the sole 36 of the club head can be made integral with the collar 16. However, this can add considerably to tooling costs and may therefore be considered undesirable from an economic point of view.

The club head block 10, collar 16 and face plate 12 are preferably held together solely by the use of a strong adhesive such as epoxy. However, it will be understood that screws can be used either alone or in conjunction with the adhesive for affixing the three parts together. The use of screws is well known in the art and for this reason is not illustrated.

Figure 8:
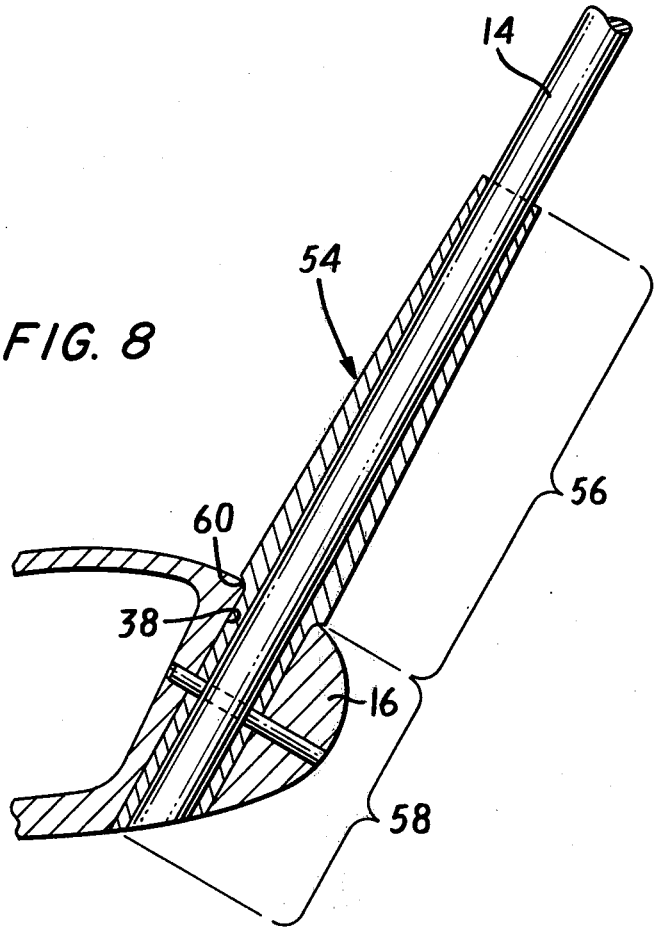
FIG. 8 shows a suitable configuration for the reinforcing sleeve for the shaft.

The shaft 14 fits into shaft receiving hole 38 of collar 16. It will be understood that where hole 26 is large, hole 38 may extend through protrusion 28 of the club head block or the protrusion of the face plate, if used. It will also be understood that the shaft receiving hole 38 can extend completely through the collar or it can penetrate only part way. If the hole 38 extends all the way through the collar, the bottom end can be covered by sole 36, if desired, by making the sole a separate piece from the reinforcing collar 16. The shaft may be affixed to the collar by a strong adhesive such as epoxy, by brazing, or a pin through the collar as is customarily used in the art and as shown in FIG. 8.

It will sometimes be found that while the method of attachment described hereinbefore is quite acceptable, the overall construction leaves something to be desired since the base of the shaft no longer has the reinforcement provided by the wooden hosel. This situation is especially likely to occur where lightweight shafts are employed. In order to strengthen the shaft at the point of attachment to the club head, a reinforcing sleeve can be employed such as that shown in FIG. 8. As there shown, the reinforcing sleeve 54 comprises a top section 56 and a lower section 58, shoulders 60 are provided for engaging the reinforcing collar 16 at the top of the shaft receiving hole 38. It is preferable that the lower section 58 be of equal extent with the shaft receiving hole 38. The top section 56 is preferably about 1¼ to 1¾ times as long as the lower section 58 but still within USGA specifications which is currently a maximum length of 5 inches from the sole to the top of the reinforcing sleeve. While the reinforcing sleeve may be of reinforced plastic, it is preferable that it be of metal, especially aluminum because of its light weight and low cost.

The shaft 14 is preferably affixed to the reinforcing sleeve 54 by adhesive such as epoxy and the reinforcing sleeve is likewise preferably affixed to the reinforcing collar by adhesive. Additionally, a standard securing pin may be employed if desired, a device used in golf clubs for many years.

The means for affixing the various components to each other is not considered an essential part of our invention and those skilled in the art will undoubtedly recognize other affixing means which can be used besides those which have been mentioned as purely illustrative and not limiting.

In accordance with the present invention, the face plate 12 is preferably a single integral unit extending throughout the length of the striking face of the club as shown. The face plate can suitably be made by molding. It it is desired to have a more conventionally appearing club, the face plate can be molded of different colors as for example by having wood grained sections at the heel and toe ends thereof and a conventionally colored trapezoidally shaped insert in the middle thereof.

FIG. 3 is shown an end view of the golf club of FIG. 1 from line 3—3 of FIG. 1. As can be seen a trip step 25 is formed at the interface of the collar 16 with the face plate 12. The face plate has a rounded edge at 24 of at least approximately 0.25 inches radius. This radius on the face plate is, of course, within the radius of the top leading edge of the club head as hereinbefore defined. The radius of the top leading edge of the club head is indicated by imaginary arc 39 which arc has a radius of at least about 0.25 inches. The leading point of this arc is indicated by 39*a*, the middle point by 39*b* and the downstream point by 39*c*. As shown, the trip step is located between the middle and downstream points. The height of the trip step 25 is from about 0.005 inches to about 0.035 inches.

Figure 4:
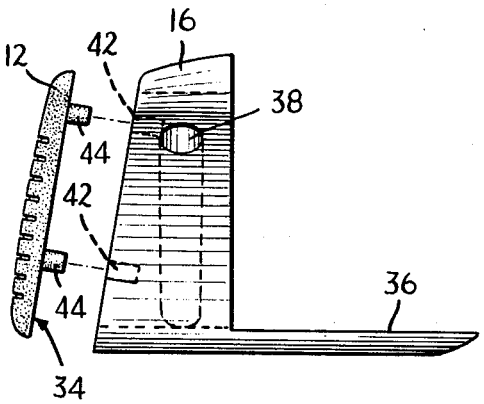
FIG. 4 is an end view of an embodiment of the present invention in which the collar is a separate piece from the face plate.

FIG. 4 is an end view of the collar 16 of FIG. 2 from line 4—4. The collar 16 has been formed integrally with the sole 36 of the club head. Shaft receiving hole 38 is provided for receiving the golf club shaft 14. Recesses 42 are provided for receiving corresponding bosses 44 of face plate 12. The bosses 44 in conjunction with the recesses 42 provide for proper alignment of the face plate 12 with respect to the collar 16.

Figure 5:
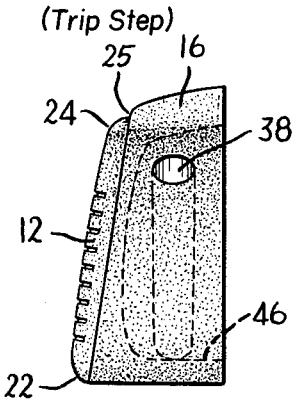
FIG. 5 is an end view showing the collar and face plate of the present invention as a unitary one piece structure.

In FIG. 5 the collar 16 and the face plate 12 have been made as one integral unit. As explained hereinbefore, this is possible where the collar is made of a plastic material rather than a metal material. Even though the collar and face plate have been formed integrally it is preferred to provide a cavity 46 in the unit so that the wood club head block 10 can have a projection 28 which fits into the cavity 46 thereby making the thickness of the striking plate 12 at the front thereof relatively thin thus imparting the best "feel" and also allowing the collar to serve as a reinforcing ring around a portion of the wood club head block.

Where the collar is made of a plastic material such as where it is made integral with the face plate, it may be desirable, depending upon the material employed, to use a reinforcing filler such as glass fibers. Where it is desired to maintain peripheral weighting by use of the collar but yet have the collar of plastic this can be done either by adding weights around the periphery of the plastic collar or by adding a dense filler to the plastic collar such as barium sulphate.

Where it is desired to have the construction of the present invention but still maintain conventional club head appearance, the collar 16 can be slightly reduced in peripheral dimension and covered with wood. This can be suitably accomplished by leaving a strip of wood around the peripheral edge of the club head block 10 so that the front face of the club head block 10 is somewhat like a torroid in shape (presuming the protrusion 28 is present in the club head block).

Figure 6:
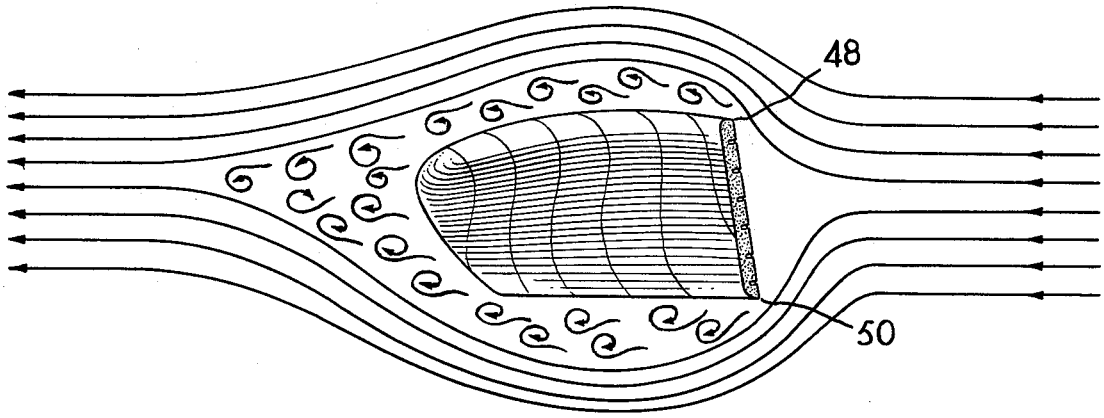
PRIOR ART FIG. 6
FIG. 6 shows the way in which air currents are believed to travel about the surface of a standard golf club.

In FIG. 6 there is shown the way in which it is believed that air currents are affected by a standard golf club head. The air currents are shown going in from the right side of the paper whereafter they meet the sharp leading edges 48 and 50 of the club head block. This is believed to cause considerable air turbulence as is shown in the drawing and it is believed that it is this air turbulence which causes the undesirable drag associated with standard gold club heads.

Figure 7:
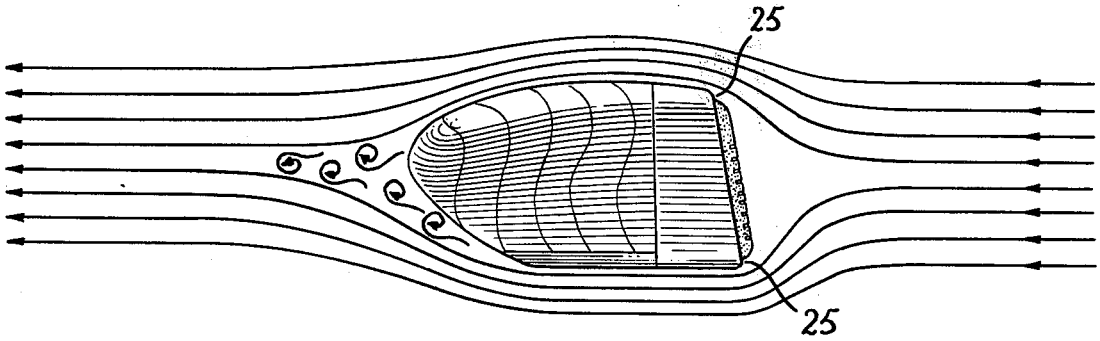
FIG. 7 shows the way in which it is believed air currents travel about a golf club according to the instant invention.

In accordance with a preferred aspect of the present invention and as shown in FIG. 7, a trip step 25 is provided on the leading edge of the club head, at least at the top and preferably also at the bottom as shown. The trip step is believed to cause the air to flow closer to the club head thereby decreasing undesirable air turbulence which is believed to cause drag.

It will be understood that the claims are intended to cover all changes and modifications of the preferred embodiments of the invention, herein chosen for the purpose of illustration, which do not constitute departures from the spirit and scope of the invention.

What is claimed is:

1. A wood type golf club having a club head and a shaft and said club head having a top surface and a bottom surface and a leading surface for striking a golf ball comprising:

a. a club head block;

b. a reinforcing collar having front and back faces, the back face being affixed to said club head block, said reinforcing collar being substantially the same in peripheral dimension as the peripheral dimension of the club head block immediately adjacent the reinforcing collar and said reinforcing collar having a hole of at least one half of a square inch in cross sectional area therethrough from front to back;

c. a face plate integral with the front face of said reinforcing collar, said face plate being in intimate contact with the club head block substantially throughout the area of the hole in the reinforcing collar;

d. a rounded edge on the top leading edge of the club head, said rounded edge having a leading, a middle and a downstream point and having a radius of a least about 0.25 inches;

e. a trip step in the radius specified in sub-paragraph (d), said trip step being located between the middle and downstream points of the radius and being from about 0.005 to about 0.035 inches in height; and f. a shaft affixed to said reinforcing collar.

2. The gold club of claim 1 further comprising a sole plate.

3. The golf club of claim 2 wherein the sole plate is integral with the reinforcing collar.

4. The golf club of claim 1 wherein there is a projection on the club head block, said projection having the same cross sectional area as the area of the hole of the reinforcing collar.

5. The golf club of claim 4 wherein the projection is the same thickness as the thickness of the reinforcing collar.

6. The golf club of claim 1 wherein the reinforcing collar and the face plate are a unitary one piece structure.

7. The golf club of claim 1 wherein the reinforcing collar and the face plate are separate pieces.

8. The golf club of claim 7 wherein the face plate is provided with bosses and the reinforcing collar with recesses and wherein the bosses correspond to recesses in the reinforcing collar.

9. The golf club of claim 1 wherein the club head block is wood.

10. The golf club of claim 9 wherein the club head block is of a maple.

11. The golf club of claim 1 wherein the reinforcing collar is metal.

12. The golf club of claim 11 wherein the reinforcing collar is composed of a material selected from the group consisting of aluminum and magnesium.

13. The golf club of claim 1 wherein the reinforcing collar is plastic.

14. The gold club of claim 13 wherein the plastic is selected from the group consisting of epoxies, polycarbonates, phenolics and butyrates.

15. The golf club of claim 13 wherein there is a filler in the reinforcing collar.

16. The golf club of claim 15 wherein the filler is a reinforcing filler.

17. The golf club of claim 16 wherein the reinforcing filler is glass fibers.

18. The golf club of claim 15 wherein the filler is more dense than the plastic material.

19. The golf club of claim 18 wherein the filler is barium sulphate.

20. The golf club of claim 1 wherein the leading edge of the bottom of the club head has a radius of at least about 0.15 inches.

21. The golf club of claim 20 wherein there is a trip step in the bottom radius.

22. A wood type gold club comprising:

a. a club head block of wood;

b. a reinforcing collar having front and back faces, the back face being affixed to said club head block, said reinforcing collar being of a material selected from the group consisting of aluminum and magnesium, said reinforcing collar being substantially the same in peripheral dimension as the peripheral dimension of the club head block immediately adjacent the reinforcing collar having a hole of at least one square inch in cross sectional area therethrough from front to back;

c. a projection on the club head block, said projection having the same cross sectional area as the area of the hole of the reinforcing collar and said projection being the same thickness as the thickness of the reinforcing collar;

d. a face plate integral with the front face of said reinforcing collar, said plate being in intimate contact with the projection on the club head block;

e. a rounded edge on the top leading edge of the club head, said rounded edge having a leading, a middle and a downstream point and having a radius of at least about 0.25 inches;

f. a trip step in the radius specified in subparagraph (e), said trip step being located between the middle and downstream points of the radius from about 0.005 to about 0.035 inches in height; and g. a shaft affixed to said reinforcing collar.

23. The golf club of claim 22 wherein the leading edge of the bottom of the club head has a radius of at least about 0.15 inches.

24. The golf club of claim 22 further comprising a sole plate.

25. The golf club of claim 24 wherein the face plate and the reinforcing collar are a unitary one piece structure.

26. The golf club of claim 21 wherein the club head block is maple.

27. The golf club of claim 1 wherein the top of the club head has a generally continuous convex surface.

28. The golf club of claim 22 wherein the top of the club head has a generally continuous convex surface.

29. In a wood type golf club having a club head and a shaft and said club head having a top surface and a bottom surface and a leading surface for striking a golf ball, the improvement comprising a rounded edge on the top leading edge of the club head, said rounded edge having a leading, a middle and a downstream point and having a radius of at least about 0.25 inches and a trip step in the radius of the rounded edge, said trip step being located between the middle and downstream points of the radius and being from about 0.005 inches to about 0.035 inches in height.

30. The gold club of claim 1 further comprising a sole plate.

31. The golf club of claim 30 wherein the sole plate and the reinforcing collar are a unitary one piece structure.

32. The gold club of claim 22 further comprising a sole plate.

33. The golf club of claim 32 wherein the sole plate and the reinforcing collar are a unitary one piece structure.

34. A "wood type" golf club having a club head and a shaft comprising:

a. a club head block of wood;

b. a reinforcing collar having front and back faces, the back face being affixed to said club head block, said reinforcing collar being substantially the same in peripheral dimension as the peripheral dimension of the club head block immediately adjacent the reinforcing collar;

c. a face plate which is a separate piece from the reinforcing collar but which is integrally affixed to the front face of said reinforcing collar;

d. a shaft affixed to said reinforcing collar;

e. the reinforcing collar having a hole in the central portion thereof of at least one-half of a square inch in cross sectional area therethrough from front to back; and f. said face plate being in intimate contact with the said club head block substantially throughout the area of the hole in the reinforcing collar.

35. The golf club of claim 34 further including a reinforcing sleeve, said reinforcing sleeve reinforcing sleeve reinforcing the shaft at its point of attachment to the reinforcing collar.

* * * * *

UNITED STATES PATENT OFFICE

CERTIFICATE OF CORRECTION

PATENT NO. : 3,985,363

DATED : October 12, 1976

INVENTOR(S) : John W. Jepson; Walter Reid; and Robert A. Brown

It is certified that error appears in the above-identified patent and that said Letters Patent are hereby corrected as shown below:

Col. 5, Line 52: "It" should read -- If --.

Col. 6, Line 51: "gold" should read --golf--

Col. 7, Line 19 (Claim 1): "a" (third occurrence) should read --at--

Col. 7, Line 27 (Claim 2): "gold" should read --golf--

Col. 7, Line 58 (Claim 14): "gold" should read --golf--

Col. 8, Line 8 (Claim 22): "gold" should read --golf--

Col. 8, Line 62 (Claim 30): "gold" should read --golf--

Col. 8, Line 67 (Claim 32): "gold" should read --golf--

Column 10, line 14, (Claim 35): delete "sleeve reinforcing".

Signed and Sealed this

Fifth Day of April 1977

[SEAL]

*Attest:*

RUTH C. MASON
*Attesting Officer*

C. MARSHALL DANN
*Commissioner of Patents and Trademarks*